US008887802B2

(12) United States Patent
Ghazi-Moradi et al.

(10) Patent No.: US 8,887,802 B2
(45) Date of Patent: Nov. 18, 2014

(54) TORQUE ABSORBTION ANCHOR SYSTEM AND METHOD TO ASSEMBLE SAME

(75) Inventors: Abbas Ghazi-Moradi, Owasso, OK (US); Donn J. Brown, Broken Arrow, OK (US); Robert C. de Long, Owasso, OK (US); John J. Mack, Catoosa, OK (US)

(73) Assignee: Baker Hughes Incorporated, Houston, TX (US)

( * ) Notice: Subject to any disclaimer, the term of this patent is extended or adjusted under 35 U.S.C. 154(b) by 477 days.

(21) Appl. No.: 13/369,462

(22) Filed: Feb. 9, 2012

(65) Prior Publication Data

US 2012/0211220 A1 Aug. 23, 2012

Related U.S. Application Data

(60) Provisional application No. 61/445,855, filed on Feb. 23, 2011.

(51) Int. Cl.

| | |
|---|---|
| ***E21B 43/00*** | (2006.01) |
| ***E21B 43/12*** | (2006.01) |
| ***E21B 23/01*** | (2006.01) |
| *E21B 17/05* | (2006.01) |

(52) U.S. Cl.

CPC ..... *E21B 43/128* (2013.01); *E21B 17/05* (2013.01); *E21B 23/01* (2013.01)

USPC ..... 166/105; 166/66.4; 166/68.5

(58) Field of Classification Search

CPC ..... E21B 43/00; E21B 43/128; E21B 17/05

USPC ..... 166/66.4, 68, 105, 68.5, 107; 415/124.2; 417/360, 423.3, 423.15, 417/424.1, 424.2, 53

See application file for complete search history.

(56) References Cited

U.S. PATENT DOCUMENTS

| | | | | |
|---|---|---|---|---|
| 2008/0202748 | A1* | 8/2008 | Bussear et al. | 166/264 |
| 2009/0044953 | A1* | 2/2009 | Sheth et al. | 166/369 |
| 2010/0247335 | A1* | 9/2010 | Atherton | 417/53 |

* cited by examiner

*Primary Examiner* — Kenneth L Thompson
*Assistant Examiner* — David Carroll
(74) *Attorney, Agent, or Firm* — Bracewell & Giuliani LLP

(57) ABSTRACT

An electric submersible pump (ESP) torque absorbtion anchor system (TAS) and a method to assemble the same are disclosed. The TAS includes a collar having an uphole end coupled to a production string and a flange formed on an outer diameter of the collar. The TAS also includes a sleeve having a rim extending radially inward from an uphole end of the sleeve. The collar is positioned in a cavity of the sleeve so that oppositely facing shoulders of the collar and the sleeve contact and transfer axial loads between the sleeve and the collar. A spring is positioned in an annulus between the sleeve and the collar and mounts to the collar and the sleeve so that rotational loading of the sleeve relative to the collar transfers to the spring.

20 Claims, 3 Drawing Sheets

TORQUE ABSORBTION ANCHOR SYSTEM AND METHOD TO ASSEMBLE SAME

This application claims priority to and the benefit of U.S. Provisional Application No. 61/445,855, by Ghazi-Moradi, et al., filed on Feb. 23, 2011, entitled "TORQUE ABSORBTION ANCHOR SYSTEM," which application is incorporated herein by reference.

FIELD OF THE INVENTION

This invention relates in general to electric submersible pumps and, in particular, to a system to absorb torque generated by electric submersible pump startup and a method to assemble the same.

BRIEF DESCRIPTION OF RELATED ART

Wells may use an artificial lift system, such as an electric submersible pump (ESP) to lift well fluids to the surface. Where ESPs are used, the ESP may be deployed by connecting the ESP to a downhole end of a tubing string and then run into the well on the end of the tubing string. The ESP may be connected to the tubing string by any suitable manner. In some examples, the ESP connects to the tubing string with a threaded connection so that an uphole end or discharge of the ESP threads onto the downhole end of the tubing string.

ESP assemblies generally include a pump portion and a motor portion. Generally, the motor portion is downhole from the pump portion, and a rotatable shaft connects the motor and the pump. The rotatable shaft is usually one or more shafts operationally coupled together. The motor rotates the shaft that, in turn, rotates components within the pump to lift fluid through a production tubing string to the surface. ESP assemblies may also include one or more seal sections coupled to the shaft between the motor and pump. In some embodiments, the seal section connects the motor shaft to the pump intake shaft. Some ESP assemblies include one or more gas separators. The gas separators couple to the shaft at the pump intake and separate gas from the wellbore fluid prior to the entry of the fluid into the pump.

The pump portion includes a stack of impellers and diffusers. The impellers and diffusers are alternatingly positioned in the stack so that fluid leaving an impeller will flow into an adjacent diffuser and so on. Generally, the diffusers direct fluid from a radially outward location of the pump back toward the shaft, while the impellers accelerate fluid from an area proximate to the shaft to the radially outward location of the pump. Each impeller and diffuser may be referred to as a pump stage. The shaft couples to the impeller to rotate the impeller within the non-rotating diffuser. In this manner, the stage may pressurize the fluid to lift the fluid through the tubing string to the surface.

When ESPs are run into a well, the motor is not operating and must be started following positioning of the ESP at the desired location in the well. In addition, the pump may be selectively started and stopped as necessary to control production from the well. During startup of an ESP motor, a substantial amount of torque is transferred up the tubing string due to the inertia of the motor. This torque can be detrimental to threaded components in the tubing string depending on the horsepower of the motor and the direction of rotation of the system. In embodiments where the tubing string is formed of a weaker material, such as fiberglass, these torsional forces can cause cracking or breaking at coupled joints of the tubular members forming the tubing string. In this manner, the torsional forces generated during motor startup limit the total horsepower of the motor that can be used and, consequently, the overall size of the ESP system. Smaller ESP systems mean that ESPs may not be used in deeper wells having greater pumping heads to overcome. Therefore, a system is needed that can reduce or eliminate the torsional forces generated by motor startup.

SUMMARY OF THE INVENTION

These and other problems are generally solved or circumvented, and technical advantages are generally achieved, by preferred embodiments of the present invention that provide a torque absorbtion anchor system and method to assemble the same.

In accordance with an embodiment of the present invention, an electric submersible pump (ESP) torque absorbtion anchor system is disclosed. The ESP torque absorbtion anchor system includes an annular sleeve having a lower end coupled to an ESP, and an annular collar having a portion coaxially inserted within the sleeve and an uphole coupled to a string of production tubing. The collar and the sleeve define an annulus therebetween. The ESP torque absorbtion anchor system also includes a torsional spring in the annulus that has a portion coupled to the sleeve and another portion coupled to the collar so that when the ESP rotates with respect to the production tubing, the torsional spring is compressed.

In accordance with another embodiment of the present invention, an electric submersible pump (ESP) system is disclosed. The ESP system includes a pump to pressurize and lift fluid through a production string, and a motor coupled to the pump so that the motor may operate the pump to pressurize and lift the fluid. The ESP system also includes a torque absorbtion anchor system having a sleeve coupled to a discharge of the pump, a collar coupled to the production string opposite the pump, and a spring connected between the sleeve and the collar. The spring is changeable from a non-compressed configuration to a compressed configuration when the pump rotates with respect to the tubing.

In accordance with yet another embodiment of the present invention, a method to assemble a torque absorbtion anchor system coupled between a production string and an electric submersible pump (ESP) is disclosed. The torque absorbtion anchor system is adapted to absorb rotational inertia of the (ESP) during startup of the ESP to prevent transfer of the rotational inertia to the production string. The method provides a collar having an axis and a flange formed proximate to a medial portion thereof, the flange forming an upward and downward facing shoulder, the collar adapted to mount to a production tubing string. The method positions a torsional spring around an outer diameter of the collar so that the torsional spring is axially below the flange and mounts an uphole end of the torsional spring to the collar. The method provides a sleeve having a rim extending radially inward from an upper end of the sleeve to form a downward facing shoulder and inserts the collar into the sleeve so that a downward facing shoulder of the rim of the sleeve rests on an upward facing shoulder of the flange. The method also mounts a lower end of the torsional spring to the sleeve so that when the sleeve rotates relative to the collar, the torsional spring winds and unwinds in response.

The disclosed embodiments provide a system that reduces the transfer of rotational inertia or torsional forces up a production string during ESP motor startup. Reducing the transfer of rotational inertia eliminates many of the torsional stresses on coupled joints secured with threaded connections. This, in turn, decreases the risk of early failure of the coupled joints. In addition, removing these torsional stresses permits use of higher horsepower ESP systems and larger ESP systems.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning electric submersible pump operation, construction, use, and the like have been omitted inasmuch as such details are not considered necessary to obtain a complete understanding of the present invention, and are considered to be within the skills of persons skilled in the relevant art.

Figure 1:
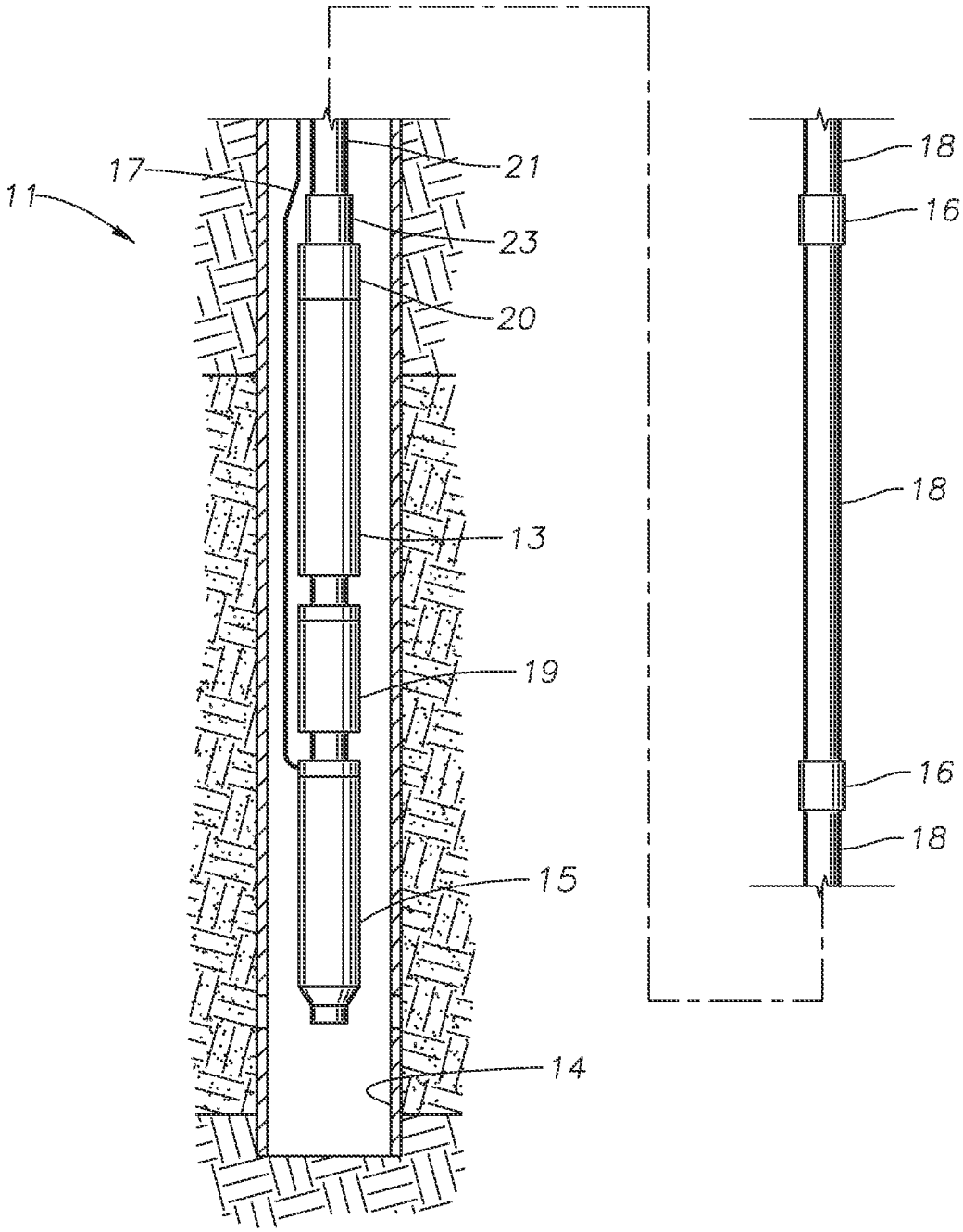
FIG. 1 is a schematic representation of an electric submersible pump coupled inline to a production string and suspended within a cased wellbore in accordance with an embodiment of the present invention.

The exemplary embodiments of the downhole assembly of the present invention are used in oil and gas wells for producing large volumes of well fluid. As illustrated in FIG. 1, downhole assembly 11 has an electrical submersible pump (ESP) 13 with a number of stages of impellers and diffusers. The pump may be driven by a downhole motor 15, which is a three-phase AC motor. Motor 15 may receive power from a power source (not shown) via power cable 17. In an embodiment, motor 15 is filled with a dielectric lubricant. A seal section 19 separates motor 15 from ESP 13 and equalizes the internal pressure of the dielectric lubricant within motor 15 to that of a cased wellbore 14 in which ESP 13 is disposed. Additional components may be included, such as a gas separator, a sand separator, and a pressure and temperature measuring module. The devices may couple to the illustrated components to remove gas, remove sand, and monitor fluid pressure and temperature of ESP 13, respectively. An uphole end of ESP 13 couples to a tubing or production string 21.

ESP 13 couples to a production string 21 through a torque absorbtion anchor system 20. Production string 21 is formed of one or more tubing string members 18 coupled with joints 16. In an exemplary embodiment, joints 16 are threaded connections. A person skilled in the art will understand that other couplings may be used to connect tubing string members 18. Tubing string members 18 and joints 16 may be formed of any suitable material, such as steel, fiberglass, or the like. An uphole end of ESP 13 couples to a downhole end of torque absorbtion anchor system 20. Similarly, an uphole end of torque absorbtion anchor system 20 couples to a coupler 23 that in turn couples to a downhole end of production string 21. In this manner, production string 21 supports the axial weight of ESP 13 within wellbore 14 as shown in FIG. 1.

Figure 2:
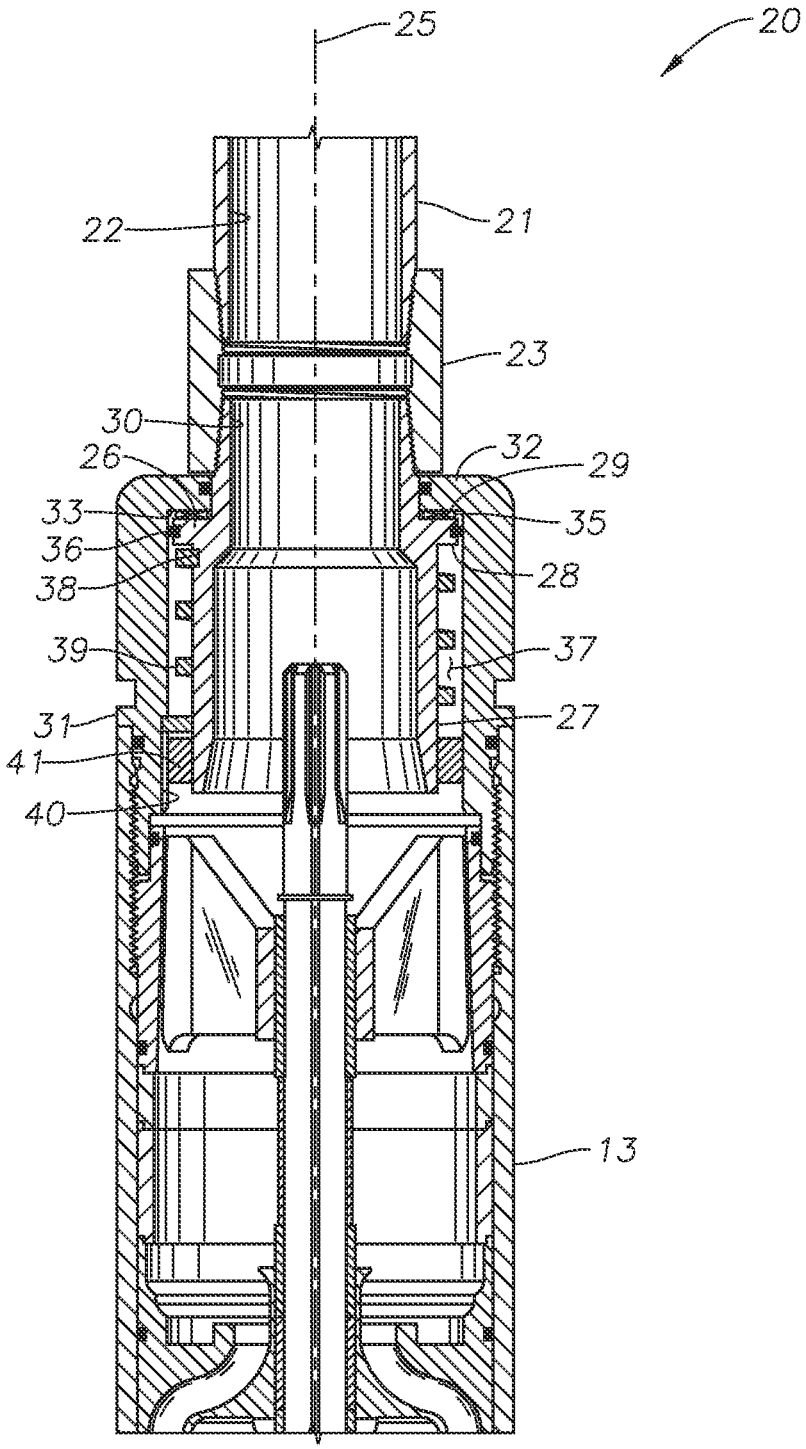
FIG. 2 is a sectional view of a torque absorbtion anchor system coupling the electric submersible pump and the production string of FIG. 1 in accordance with an embodiment of the present invention.

Referring to FIG. 2, production string 21 defines a passageway 22 allowing for the passage of fluids, such as hydrocarbons, uphole. The downhole end of production string 21 is tapered and has a thread formed on an outer diameter of production string 21. In an exemplary embodiment, the downhole end of production string 21 inserts into coupler 23 and threads to a matching thread on the inner diameter of coupler 23. In this manner, production string 21 secures to coupler 23 so that production string 21 and coupler 23 are coaxial with an axis 25. In addition, coupler 23 and production string 21 are non-rotational relative to each other.

The torque absorbtion anchor system 20 includes an annular collar 27, coaxial with axis 25 that has an uphole end with an outer diameter having a thread that mates with a corresponding thread on an inner diameter of a downhole end of coupler 23. The uphole end of collar 27 inserts into and screws to coupler 23, securing collar 27 to production string 21. Similar to production string 21, collar 27 and coupler 23 are non-rotational relative to each other. Collar 27 includes a flange 26 formed on an outer diameter of a medial portion of collar 27. Flange 26 has an upward facing shoulder 29 and a downward facing shoulder 28 facing ESP 13 opposite upward facing shoulder 29. Collar 27 also includes a collar passageway 30 that is coaxial with passageway 22 for passage of fluids, such as hydrocarbons, from ESP 13 through collar 27 to production string 21.

The torque absorbtion anchor system 20 also includes a pump head or sleeve 31 with a rim 32 extending radially inward from the uphole end of sleeve 31. Rim 32 has a downward facing shoulder 33 on an inner portion of sleeve 31 facing the cavity formed by sleeve 31 and rim 32. Collar 27 resides within the cavity formed by sleeve 31 and is coaxial with axis 25. The uphole threaded end of collar 27 extends through and is spaced-apart from an uphole end of sleeve 31. When collar 27 is positioned within sleeve 31 as shown in FIG. 2, shoulder 33 may abut shoulder 29, so that an upward axial load on collar 27, such as when ESP 13 must be removed and repaired, will transfer to sleeve 31. Similarly, a downward axial load on sleeve 31, such as the weight of ESP 13, will transfer to collar 27. In an exemplary embodiment, one or more bearings 35 are interposed between upward facing shoulder 29 of collar 27 and downward facing shoulder 33 of sleeve 31. Bearings 35 may be rolling element bearings or the like, such that bearings 35 may facilitate rotation of sleeve 31 relative to collar 27 while bearing the axial load between collar 27 and sleeve 31. In an example, sleeve 31 and collar 27 may rotate independently through bearings 35. As shown in FIG. 2, a seal 36 circumscribes flange 26 axially beneath bearings 35. Seal 36 substantially fills a gap between flange 26 of collar 27 and an inner diameter of the cavity of sleeve 31. Seal 36 seals collar 27 to sleeve 31 so that fluid flows through collar passageway 30 into passageway 22 of production tubing 21. A person skilled in the art will understand that any suitable seal may be used, such as the o-ring seal illustrated in FIG. 2.

An inner diameter of sleeve 31 is larger than an outer diameter of collar 27 such that an annulus 37 is formed between collar 27 and sleeve 31 axially below flange 26. A torsional spring 39 is positioned within annulus 37 and surrounds collar 27 in annulus 37. Collar 27 includes a notch 38 formed proximate to downward facing shoulder 28 of flange 26 so that the uphole end of torsional spring 39 may insert into notch 38 and retain to collar 27. Notch 38 is of a sufficient size and shape to allow torsional spring 39 to exert a rotational force on notch 38 that will wind and unwind spring 39 without the end inserted into notch 38 slipping out of or becoming dislodged from notch 38. A downhole end of torsional spring 39 couples to sleeve 31 near a downhole end of sleeve 31 at a slot 40 configured to receive a downhole end of torsional spring 39. Similar to notch 38 of collar 27, slot 40 of sleeve 31 will be of sufficient size and shape to allow torsional spring 39 to receive a rotational force from sleeve 31 that will wind and unwind spring 39 without the end inserted into slot 40 slipping out of or becoming dislodged from slot 40. As sleeve 31 begins to rotate relative to collar 27 due to a torque applied to sleeve 31, described in more detail below, torsional spring 39 will initially absorb the rotation, maintaining collar 27 stationary by winding around collar 27. Torsional spring 39 will then unwind as the torque applied to sleeve 31 reaches an equilibrium, returning sleeve 31 to its original position relative to collar 27 prior to the application of the torque to sleeve 31.

In the illustrated embodiment, an alignment bushing 41 is positioned within annulus 37 between the outer diameter of collar 27 and the inner diameter of sleeve 31. Alignment bushing 41 maintains the downhole ends of sleeve 31 and collar 27 coaxial relative to one another during assembly and operation of torque absorbtion anchor system 20. As shown, alignment bushing 41 mounts proximate to the downhole ends of collar 27 and sleeve 31. Alignment bushing 41 may be formed of any suitable material, such as an elastomer, provided alignment bushing 41 permits relative rotation between collar 27 and sleeve 31. A downhole end of sleeve 31 couples to ESP 13 in any suitable manner such that ESP 13 and sleeve 31 may move axially and rotationally as a single body. In the illustrated embodiment, ESP 13 and sleeve 31 couple through a mating threaded connection. A person skilled in the art will understand that any suitable coupling may be used to couple sleeve 31 to ESP 13, provided ESP 13 may transfer rotational inertia from ESP 13 to sleeve 31 as described in more detail below.

Figure 3:
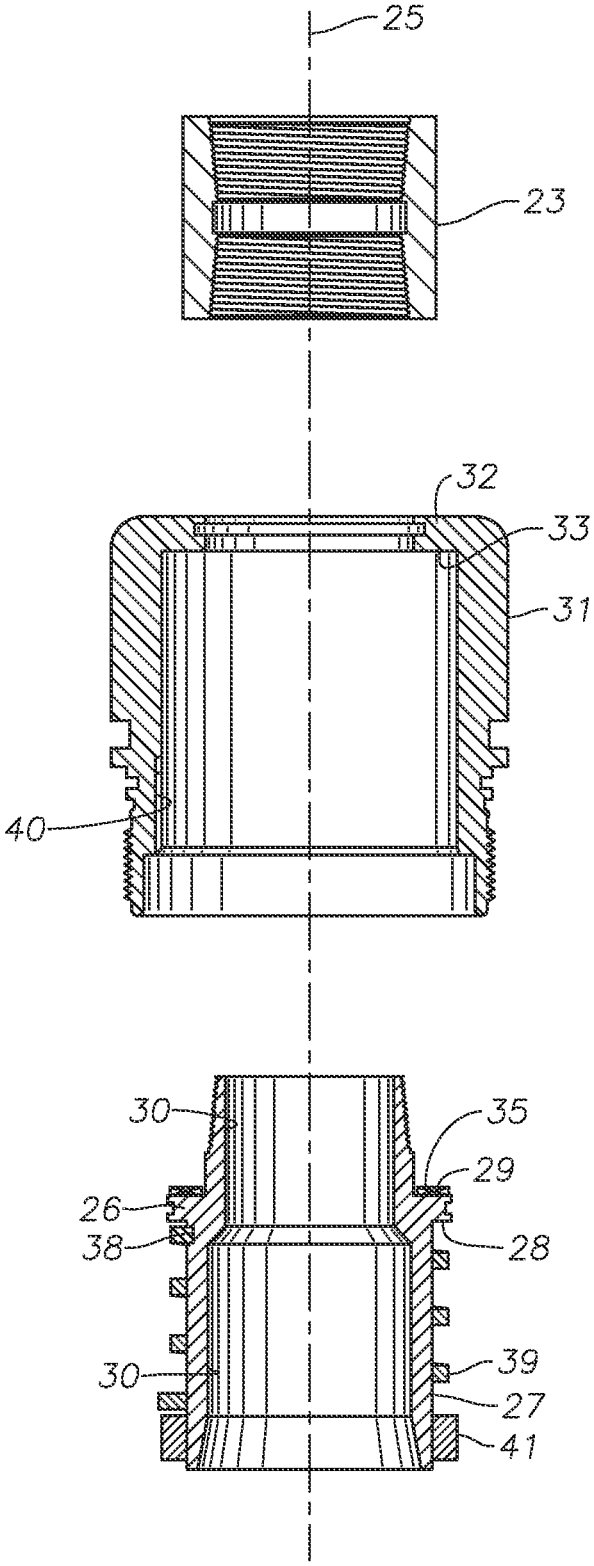
FIG. 3 is a sectional assembly drawing of the torque absorbtion anchor system of FIG. 2 in accordance with an embodiment of the present invention.

As shown in FIG. 3, torque absorbtion anchor system 20 may be assembled as follows. Bearings 35 may be positioned on upward facing shoulder 29 of collar 27, and torsional spring 39 will be placed around collar 27 so that the uphole end of torsional spring 39 inserts and secures to notch 38 axially beneath flange 26. Collar 27 may then be inserted into sleeve 31 so that the uphole threaded portion of collar 27 passes through the uphole end of sleeve 31 allowing downward facing shoulder 33 of rim 32 to abut bearings 35 opposite upward facing shoulder 29 of flange 26. Torsional spring 39 will insert into slot 40 of sleeve 31, thereby securing the downhole end of torsional spring 39 to sleeve 31. Coupler 23 is then threaded onto the uphole end of collar 27. When collar 27 is fully threaded to coupler 23, a downhole rim of coupler 23 may be proximate to rim 32 of sleeve 31, providing a barrier to upward axial movement of sleeve 31. In this manner, coupler 23 may limit axial movement of sleeve 31 by axially securing sleeve 31 to collar 27, while allowing for independent rotational motion between collar 27 and sleeve 31 at bearings 35.

In operation, during startup of ESP 13, initial operation of motor 15 generates rotational inertia in ESP 13 that urges ESP 13 to rotate. Rotation of ESP 13 causes sleeve 31 to rotate. Sleeve 31 rotates on bearings 35 relative to collar 27. In so doing, torsional spring 39, mounted to a downhole end of sleeve 31, receives the torsional load through slot 40, causing torsional spring 39 to wind in response. The uphole end of torsional spring 39 is secured to collar 27 in notch 38, which remains stationary as torsional spring 39 absorbs the rotational inertia. As the rotational inertia reduces and stabilizes during the startup process of ESP 13, the reactive forces generated by rotating torsional spring 39 from equilibrium may exert a counter rotational force that overcomes the equalizing rotational inertia of ESP 13, causing torsional spring 39 to unwind. This rotates sleeve 31 relative to collar 27 in the opposite direction, returning sleeve 31 and ESP 13 to their original positions. In an example, total rotation of ESP 13 and sleeve 31 is less than one revolution.

Accordingly, the disclosed embodiments provide numerous advantages. For example, the disclosed embodiments provide a system that reduces the transfer of rotational inertia or torsional forces up a production string during ESP motor startup. Reducing the transfer of rotational inertia eliminates many of the torsional stresses on coupled joints secured with threaded connections. This, in turn, decreases the risk of early failure of the coupled joints. In addition, removing these torsional stresses permits use of higher horsepower ESP systems and larger ESP systems.

This application claims priority to and the benefit of copending U.S. Provisional Application No. 61/445,855, by Ghazi-Moradi, et al., filed on Feb. 23, 2011, entitled "TORQUE ABSORBTION ANCHOR SYSTEM," which application is incorporated herein by reference.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. An electric submersible pump (ESP) torque absorbtion anchor system comprising:

an annular sleeve having a lower end coupled to an ESP;

an annular collar having a portion coaxially inserted within the sleeve and an uphole end coupled to a string of production tubing;

an annulus defined between the sleeve and the collar; and a torsional spring in the annulus and having a portion coupled to the sleeve and another portion coupled to the collar so that when the ESP rotates with respect to the production tubing, the torsional spring is compressed.

2. The system of claim 1, further comprising an alignment bushing positioned in the annulus axially beneath the torsional spring and proximate to the downhole end of the collar, the alignment bushing adapted to position downhole ends of the sleeve and the collar coaxially.

3. The system of claim 1, further comprising a coupler threadingly connected to the production string and the collar and further adapted to maintain the axial positions of the collar and the sleeve relative to one another.

4. The system of claim 3, wherein a lower end of the coupler is proximate to the rim of the sleeve when the collar threads to the coupler, thereby limiting upward axial movement of the sleeve relative to the collar through contact between the rim of the sleeve and the coupler.

5. The system of claim 1, wherein the collar further comprises a flange formed on an outer diameter of the collar proximate to a medial portion of the collar.

6. The system of claim 1, wherein the sleeve has an inner surface with a slot, and where the spring couples to the sleeve by insertion into the slot.

7. The system of claim 1, wherein the sleeve further comprises a rim extending radially inward from an uphole end of the sleeve.

8. The system of claim 1, wherein one or more bearings are interposed between the upward facing shoulder of the collar and the downward facing shoulder of the sleeve so that the sleeve and the collar rotate on the bearings.

9. The system of claim 8, wherein the one or more bearings are roller bearings.

10. An electric submersible pump (ESP) system comprising:

a pump to pressurize and lift fluid through a production string;

a motor coupled to the pump so that the motor may operate the pump to pressurize and lift the fluid; and a torque absorption anchor system having a sleeve coupled to a discharge of the pump, a collar coupled to the production string opposite the pump, and a spring connected between the sleeve and the collar that is changeable from a non-compressed configuration to a compressed configuration when the pump rotates with respect to the tubing.

11. The system of claim 10, wherein the torque absorbtion anchor system comprises:

the collar having an axis and an uphole end for coupling to a production string and a flange formed on an outer diameter of the collar proximate to a medial portion of the collar, the collar having a downhole end opposite the uphole end;

the sleeve having a rim extending radially inward from an uphole end of the sleeve, the rim forming a downward facing shoulder proximate to a uphole end of the sleeve, the sleeve coaxial with the axis of the collar, the collar positioned in a cavity of the sleeve so that the uphole end of the collar protrudes and is axially spaced-apart from the uphole end of the sleeve and the downward facing shoulder of the sleeve contacts the upward facing shoulder of the collar to transfer axial loads from the sleeve to the collar through the upward and downward facing shoulders;

one or more bearings are interposed between the upward facing shoulder of the collar and the downward facing shoulder of the sleeve so that the sleeve and the collar rotate on the bearings;

an annulus formed between an inner diameter of the sleeve and an outer diameter of the collar; and a torsional spring positioned in the annulus and having an uphole end mounted to the collar and a downhole end mounted to the sleeve, the torsional spring adapted to wind in response to rotational loading of the sleeve relative to the collar and unwind in response to removal of the rotational loading.

12. The system of claim 11, further comprising an alignment bushing positioned in the annulus axially beneath the torsional spring and proximate to the downhole end of the collar, the alignment bushing adapted to position downhole ends of the sleeve and the collar coaxially.

13. The system of claim 10, further comprising a coupler adapted to threadingly connect to the production string and the collar and further adapted to maintain the axial positions of the collar and the sleeve relative to one another.

14. The system of claim 13, wherein a lower end of the coupler is proximate to a rim of the sleeve when the collar threads to the coupler, thereby limiting upward axial movement of the sleeve relative to the collar through contact between the rim of the sleeve and the coupler.

15. The system of claim 10, wherein the system further comprises one or more seals interposed between the collar and the sleeve to seal between the collar and the sleeve.

16. A method to assemble a torque absorbtion anchor system coupled between a production string and an electric submersible pump (ESP), the torque absorbtion anchor system adapted to absorb rotational inertia of the (ESP) during startup of the ESP to prevent transfer of the rotational inertia to the production string, the method comprising:

(a) providing a collar having an axis and a flange formed proximate to a medial portion thereof, the flange forming an upward and downward facing shoulder, the collar adapted to mount to a production tubing string;

(b) positioning a torsional spring around an outer diameter of the collar so that the torsional spring is axially below the flange and mounting an uphole end of the torsional spring to the collar;

(c) providing a sleeve having a rim extending radially inward from an upper end of the sleeve to form a downward facing shoulder;

(d) inserting the collar into the sleeve so that a downward facing shoulder of the rim of the sleeve rests on an upward facing shoulder of the flange; and (e) mounting a lower end of the torsional spring to the sleeve so that when the sleeve rotates relative to the collar, the torsional spring winds and unwinds in response.

17. The method of claim 16, wherein step (d) further comprises positioning one or more roller bearings on the upward facing shoulder of the flange to reduce friction between the upward facing shoulder of the flange and the downward facing shoulder of the rim to increase instances of rotation of the sleeve relative to the collar.

18. The method of claim 16, further comprising coupling an uphole end of the collar to a coupler so that the coupler limits upward axial movement of the sleeve relative to the collar.

19. The method of claim 18, further comprising coupling the coupler to a downhole end of the production tubing string and the downhole end of the sleeve to a discharge of the ESP.

20. The method of claim 16, further comprising mounting an alignment bushing between an outer diameter of the collar and an inner diameter of the sleeve to maintain coaxial alignment of the sleeve relative to the collar.

* * * * *

UNITED STATES PATENT AND TRADEMARK OFFICE

CERTIFICATE OF CORRECTION

PATENT NO. : 8,887,802 B2
APPLICATION NO. : 13/369462
DATED : November 18, 2014
INVENTOR(S) : Abbas Ghazi-Moradi et al.

It is certified that error appears in the above-identified patent and that said Letters Patent is hereby corrected as shown below:

In the Specification

Column 2, line 21, insert --end-- between “uphole” and “coupled”

Signed and Sealed this
Sixteenth Day of June, 2015

Michelle K. Lee

Michelle K. Lee
*Director of the United States Patent and Trademark Office*